US005460219A

United States Patent [19]

Massin et al.

[11] Patent Number: 5,460,219

[45] Date of Patent: Oct. 24, 1995

[54] METHOD AND DEVICES FOR DECORING CASTINGS

[75] Inventors: Marcel Massin; Daniel Massin, both of Bazeilles, France

[73] Assignee: Massin Limited Company, Bazeilles, France

[21] Appl. No.: 934,540

[22] PCT Filed: Feb. 4, 1992

[86] PCT No.: PCT/FR92/00095

§ 371 Date: Nov. 12, 1992

§ 102(e) Date: Nov. 12, 1992

[87] PCT Pub. No.: WO92/13603

PCT Pub. Date: Aug. 20, 1992

[30] Foreign Application Priority Data

| | | | |
|---|---|---|---|
| Feb. 7, 1991 | [FR] | France | 91 01385 |
| Aug. 14, 1991 | [FR] | France | 91 10389 |

[51] Int. Cl.[6] ..... B22D 29/00

[52] U.S. Cl. ..... 164/132; 164/404

[58] Field of Search ..... 164/132, 131, 164/401, 404, 260; 241/DIG. 10, 175, 284

[56] References Cited

U.S. PATENT DOCUMENTS

| | | | |
|---|---|---|---|
| 4,185,681 | 1/1980 | Church et al. | 164/131 X |
| 4,637,558 | 1/1987 | Jenzsch et al. | 241/DIG. 10 X |
| 4,718,473 | 1/1988 | Musschoot | 164/404 X |

FOREIGN PATENT DOCUMENTS

| | | | |
|---|---|---|---|
| 0111461 | 6/1984 | European Pat. Off. | 164/132 |
| 0326138 | 8/1989 | European Pat. Off. | 164/131 |
| 3239262 | 4/1984 | Germany | 164/132 |

*Primary Examiner*—J. Reed Batten, Jr.
*Attorney, Agent, or Firm*—Weintraub, DuRoss & Brady

[57] ABSTRACT

Sand cores are broken up and removed from castings, particularly from cylinder heads from internal combustion engines. A pneumatic hammer is applied to the casting while the casting is held against a low pressure cylinder. The casting is subjected to horizontal oscillation by a receiver actuated by a rod and a double eccentric rotatably driven by a geared motor.

22 Claims, 7 Drawing Sheets

80
81

20
21
40
1
50
43
80
43
50
1
40
21
20

20
21
40
1
50
43
80
43
50
1
40
21
20

METHOD AND DEVICES FOR DECORING CASTINGS

TECHNICAL FIELD

The invention concerns a process and devices for decoring casting cores.

BACKGROUND ART

The elimination of casting cores with a rather complex structure very often requires the use of a pneumatic hammer allowing to subject the part to repeated shocks which may break the adherence of sand on the walls.

Initially, this operation was done manually holding the pneumatic hammer and relying on the dexterity and know-how of the operator, which resulted in some disparities in the result achieved and in the rejection of a rather large percentage of finished pieces not completely decored.

In order to rationalize this operation and to protect the operator from resulting nuisances such as noise and dust, the use of devices such as those described in French patent No. 2.311.617 and European patent No. 0.144.031 was considered. Those devices basically consist of a frame onto which one or more decoring parts are mounted while said frame is subject to vibrations likely to cause the unsticking and splitting of the cores.

In order to increase even further the performance of this device, the French patent No. 2.470.652 provides for several frames on a polygonal roundabout driven in step rotation before a loading station and an unloading station diametrically opposite.

However, it should be noted that the vibrations thus regularly applied to the pieces do not ensure adequate splitting of the core, or full unsticking of all fragments of said core.

The result of this situation is a certain reluctance from the designers to use complex designs which may hinder such decoring although this would be highly desirable for the future use of the piece.

This problem is of special significance for internal combustion motor cylinder heads where the most complex designs are very often impossible to fully decore, with the trouble this implies in assembly lines and the fact that designers give up on such designs.

The purpose of this invention is to correct all those disadvantages. This invention, as described, solves the problem of defining a process and creating devices with which the cores cannot only be split up but also fully disintegrated while causing an erosion effect which leads to the unsticking of all sand particles before full gravity discharge in one single phase, preferably without repositioning the piece on its support.

SUMMARY OF THE INVENTION

The process under the invention is mainly characterized by the sequence of the following operations:

- application of shocks at high frequency, directly onto the piece while said piece is held against a pneumatic cushion to make the core split up,
- swinging of the piece under a reciprocating motion to achieve full disintegration of the core and a sandblasting effect of the casting inside walls,
- gravity discharge of the sand as the core is disintegrated.

Under one embodiment of the process, the reciprocating swinging results from the combination of a longitudinal reciprocating motion and a transverse reciprocating motion.

According to a first alternative solution of the above embodiment, the transverse reciprocating motion is applied in a plane parallel to that in which the longitudinal motion is applied.

According to a second alternative solution of the same embodiment, the transverse reciprocating motion is applied in a plane perpendicular to that in which the longitudinal motion is applied.

According to a special definition of the process, the swinging of the piece is achieved with an amplitude and frequency respectively adjustable from greater than 0 to 10 cm and 0 to 85 Hz.

According to another special definition of the process, the swinging of the piece is achieved in combination with the taking up of a play J, thus introducing an additional inertia effect on the sand mass.

Regardless of the embodiment and definition of the process, the amplitude and frequency of the piece swinging vary during the swinging motion according to rules determined on the basis of the inside design of the piece and the size of the cavities.

According to another definition of the process, the swinging frequency is irregular and random.

An embodiment of the basic process under the invention is characterized by the fact that shocks at high frequency are applied directly onto the piece through a pneumatic hammer mounted on a support integral with a frame, arranged in such manner so as to directly hit the piece as the pneumatic hammer moves through a hole provided for that purpose in a fixed backing plate against which the piece is maintained through a clamping plate and a low pressure chamber jack forming the air cushion in the sense that the piece swinging under an horizontal reciprocating motion is achieved through a receiver including the backing plate, clamping plate and fastening jack, vertically connected to the frame with four connecting rods and horizontally with a connecting rod and a double cam rotation-driven through a motor reducer as the sand gravity discharge is achieved by maintaining the piece in a vertical position while abutting it against a mechanical stop integral with the backing plate.

The receiver is preferably made of two side plates in a swan neck shape, interconnected through the backing plate and through a connecting plate supporting the pneumatic chamber jack resting, on one hand, against the clamping plate mounted with rams on four slides connecting the backing plate to the connecting plate, perpendicular thereto.

The vertical connecting rods are connected to the side plates through elastic joints.

The horizontal connecting rod is connected to the connecting plate through a strap.

According to another embodiment of the device under the abovedescribed invention, the receiver is equipped with a piece-holding housing mounted with a certain play between the connecting plate and the backing plate, supported on four vertical small rods attached against the inside wall of the side plates through an elastic joint, or directly onto the frame the same way.

Whenever a play J must be provided between the clamping plate and the piece, such play must be achieved by mounting sleeves of a length determined according to the thickness of the piece, on the slides between the backing plate and the clamping plate or through two jacks mounted opposite to each other across the connecting plate with the rod of one attached to the strap and the rod of the other one backing against the clamping plate to control the play J to be provided for between said clamping plate and the piece; said plate being then made integral with its slides through a locking system built into the rams.

According to a preferred embodiment of the first device under the invention, two receivers are mounted on one single frame on both sides of one single cam, thus ensuring the simultaneous swinging of two pieces in the alignment of two pneumatic hammers placed at each end of the frame.

According to the first process alternative embodiment under the invention, the transverse reciprocating motion is achieved through a crankshaft connected to a piece-holding capsule through at least one rod as said piece-holding capsule is supported with a frame through four rods jointed in planes perpendicular to the crankshaft and as the frequency of the reciprocating swinging is made irregular and random through the associated variation of the crankshaft drive motor rotation speed.

According to the second alternative process embodiment under the invention, the transverse reciprocating motion is achieved in a plane perpendicular to the longitudinal motion through a crankshaft connected to the piece-holding capsule through at least one bearing installed under the latter as the reciprocating swinging frequency is made irregular and random through the associated variation of the crankshaft drive motor rotation speed.

The crankshaft is installed in the longitudinal median plane of the piece-holding capsule while the springs are distributed in two rows arranged symmetrically to the crankshaft.

According to another embodiment of the first alternative process application under the invention, the longitudinal reciprocating motion and the transverse reciprocating motion are combined in one single motion ensuring the overall reciprocating swinging through two crankshafts vertically placed between a frame and a piece-holding capsule support as the frequency of the reciprocating swinging is made irregular and random through the associated variation of the crankshaft drive motor rotation speed.

Regardless of the process alternative applications and their embodiments, the speed variation of the cam or crankshaft drive motor is achieved through a computer-controlled variator.

The advantages offered by this invention consist mainly of the fact that hollow pieces of complex design such as cylinder heads of internal combustion engines can be cast without any risk of problem in removing all of the core while at the same time improving the wall surface condition through sandblasting, thus enhancing the subsequent flow of liquid or gaseous fluids due to run through the cavities provided inside the piece even according to a highly complex arrangement.

BRIEF DESCRIPTION OF THE DRAWINGS

Other features and advantages will become obvious in the following description of one invention embodiment designed to decore motor cylinder heads, given as a non-restrictive example in view of the attached diagrams where.

DETAILED DESCRIPTION OF THE INVENTION

Figure 1:
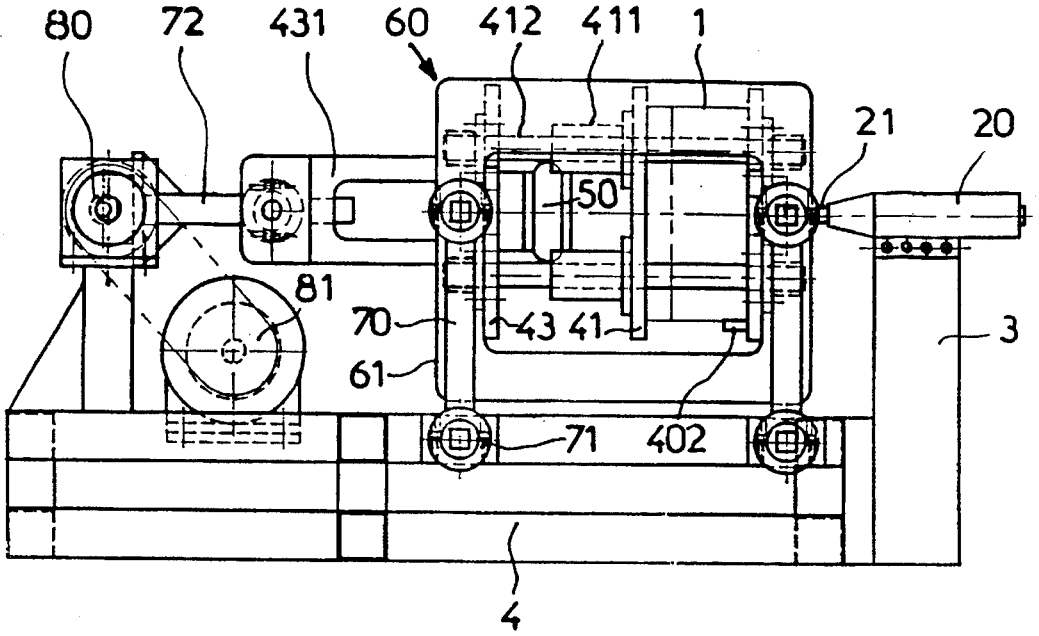
FIG. 1 represents a front view of a device with longitudinal reciprocating motion, without longitudinal play, applicable to the basic process.
Figure 2:
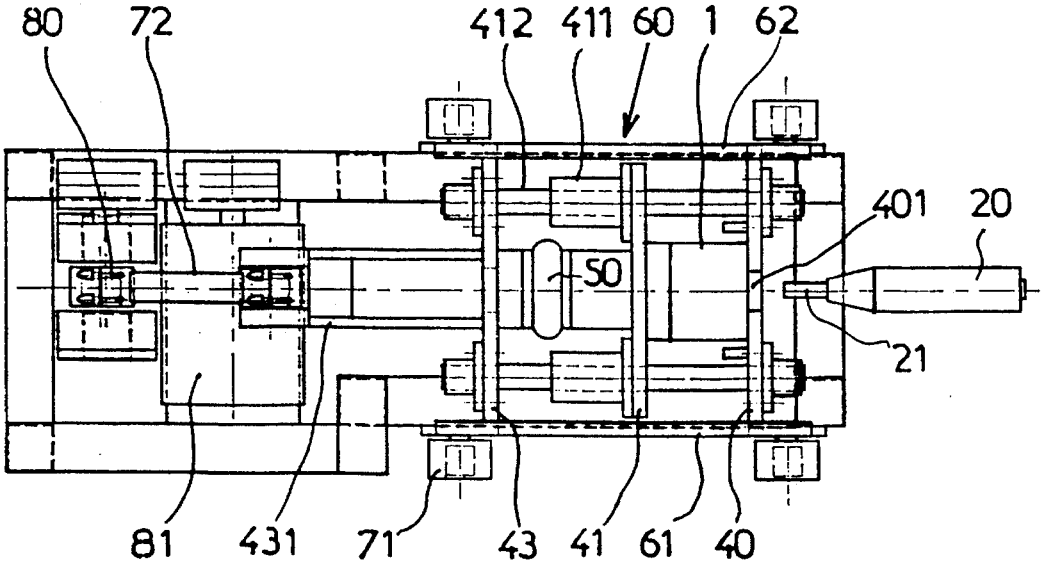
FIG. 2 represents a top view of the device according to FIG. 1.

FIGS. 1 and 2 represent a piece 1, mounted on a casting core splitting and removal device under the invention, comprising a pneumatic hammer 20 with a peen 21, secured on a support 3 integral with a frame 4 placed so as to hit directly piece 1 when peen 21 passes through hole 401 provided for that purpose in a fixed backing plate 40 with vertical stop 402 against which piece 1 is held through a clamping plate 41 subject to the action of a low pressure chamber jack 50 forming an air cushion; said backing plate 40 and clamping plate 41 are part of a receiver 60 connected vertically to frame 4 through four rods 70 with elastic joint 71 and horizontally through a rod 72 connected on one hand to a double cam 80 driven by a motor reducer with variable speed 81 and on the other hand through a strap 431 with a connecting plate 43 supporting the chamber jack 50 connecting transversely and in combination with the backing plate 40 two clamping plates in the shape of a swan neck 61, 62; the clamping plate 41 is mounted through rams 411 on four slides 412 connecting the backing plate 40 to the connecting plate 43.

Figure 3:
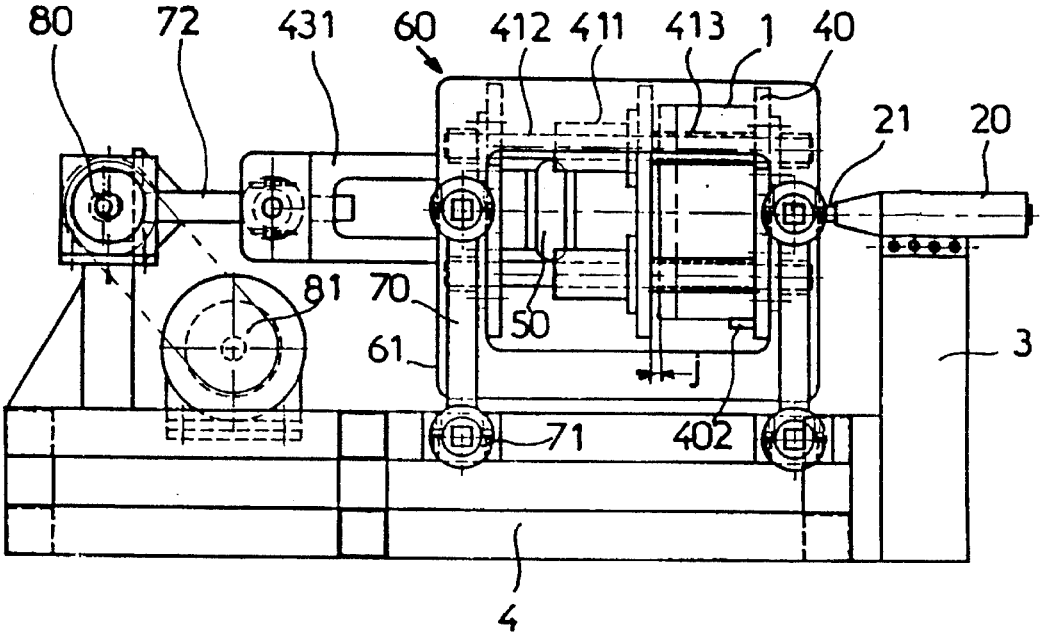
FIG. 3 represents a front view of a device with longitudinal play.
Figure 4:
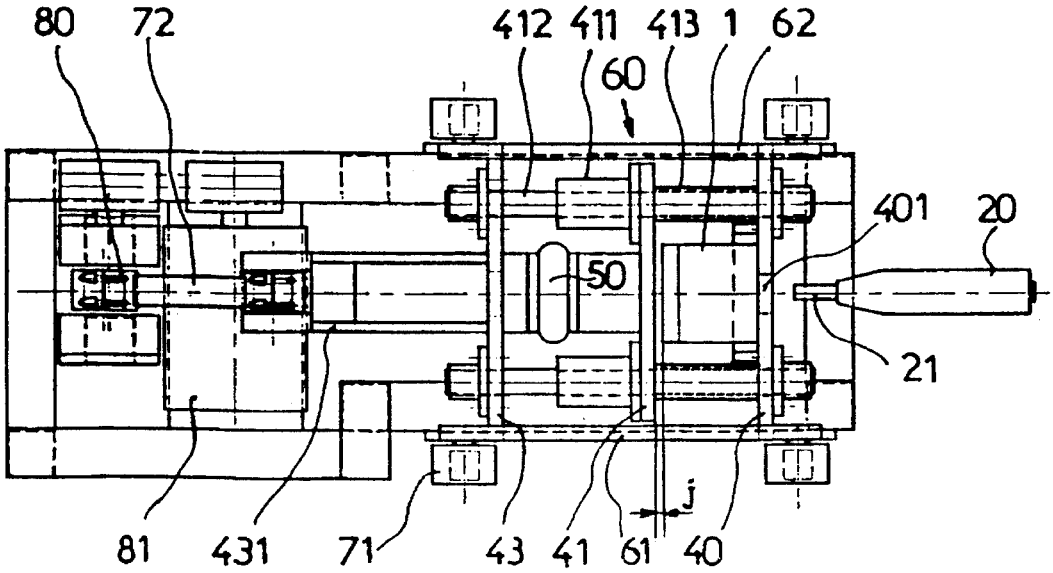
FIG. 4 represents a top view of the device according to FIG. 3.

FIGS. 3 and 4 represent a piece mounted with a play J on a casting core splitting and removal device which differs from that represented in FIGS. 1 and 2 only through the presence of sleeve 413 forming a stop on slides 412 between the backing plate 40 and the clamping plate 41.

A closer examination of FIGS. 1 and 2 shows that—provided that the useful length of rod 72 has been previously adjusted to give the necessary and sufficient gap between backing plate 40 and clamping plate 41 for a determined no-load length of chamber jack 50—pieces 1 can be introduced directly from above, or possibly laterally, into the space thus provided between both plates 40, 41, it being understood that stop 402 present on the backing plate 40 limits the penetration of piece 1 into that space without having to use any blocking system. It should be noted that on some plane-shaped pieces, such pieces can be clamped directly without interposition of the clamping plate 41.

With the receiver 60 now brought to the end of its travel toward the pneumatic hammer 20 by controlled action on the double cam 80 through the motor reducer 81, the operation can now start since the peen 21 of the pneumatic hammer 20 can hit directly the piece through the hole 401 provided for that purpose. This high frequency hammering on the resonant assembly consisting of piece 1 with clamping plate 41 and low pressure chamber jack 50 causes the splitting and unsticking of the core in the vicinity of the system natural resonance frequency. This resonance phenomenon can be controlled by adjusting the inflation pressure of chamber jack 50 and the hammering frequency.

Upon completion of this operation, full disintegration of the core fragments can be undertaken through the back and forth swinging of piece 1 by acting on the receiver 60 supported by the vertical connecting rods 70, through continuous operation of the motor reducer 81 driving the double cam 80 which imparts to said receiver 60 a reciprocating horizontal motion with a travel and frequency determined by the connecting rod 72 and the strap 431 attached perpendicularly to the connecting plate 43. The core fragments resulting from the splitting produced by the previous operation are subject to inertia effects which cause their gradual disintegration as they are knocked against one another; this operation causes some erosion of the rough spots which may remain in the inaccessible cavities and full loosening of the stickiest sand particles through a "sandblasting" effect well known in the mechanical industry.

Provided that piece 1 is properly presented on the receiver, the sand resulting from the core disintegration is gravity-flown between the side plates 61, 62 of said receiver and the girders of frame 4. Said sand can be discharged as it is released over a conveyer belt. The frequency of the swinging movement and its amplitude may be respectively adjusted using a speed controller and the double cam.

Figure 5:
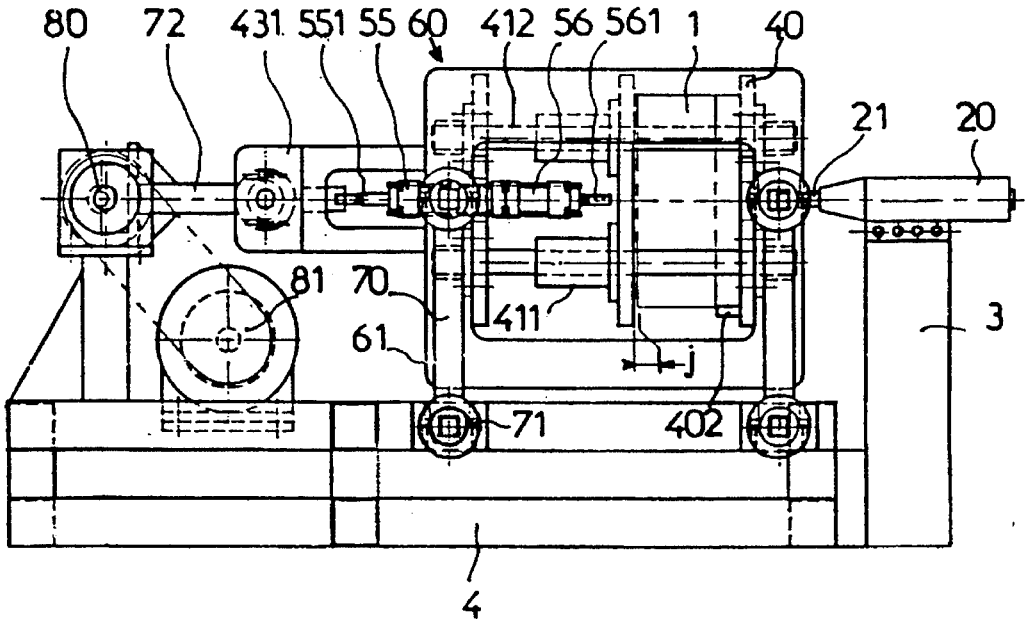
FIG. 5 represents a front view of an alternative embodiment of the device with longitudinal reciprocating motion and longitudinal play.
Figure 6:
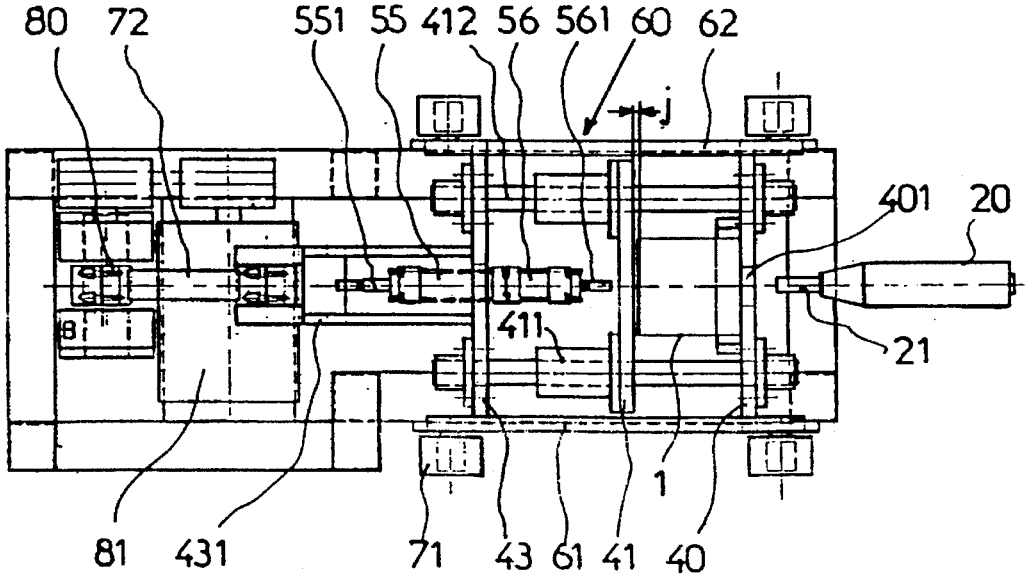
FIG. 6 represents a top view of the device according to FIG. 5.

In some cases, the core fragment disintegrating action may be even further enhanced by providing for a play J between the so-called clamping plate 41 and piece 1 by adding a sleeve 413 of proper length on slides 412 (FIGS. 3 and 4), or, as represented in FIGS. 5 and 6, through two jacks 55 and 56 mounted opposite to each other and running through the connecting plate 43 with the rod 551 of one connected to strap 431 and the rod 561 of the other backing against the clamping plate 41 or directly against piece 1 so as to provide the latter with a play J controlled in the horizontal plane; the clamping plate 41 is then made integral with its slides through locking devices built into the rams 411. Thus, jack 55 provides for the movement of the clamping plate depending on the thickness of the piece and jack 56 only provides for play J. This arrangement which corresponds to FIGS. 3 through 6, makes it possible to increase even further the inertia effect and consequently the collision of the various core fragments; it also facilitates the sand discharge when dealing with pieces with rather complex internal design.

Figure 7:
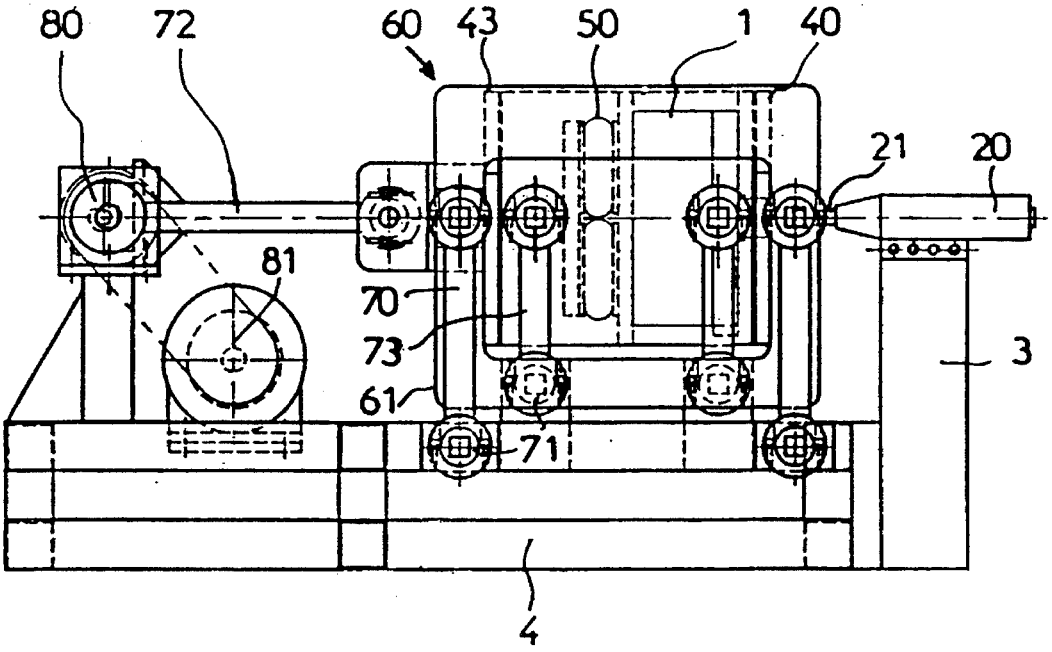
FIG. 7 represents a front view of a special embodiment of the device with horizontal reciprocating motion and longitudinal play.
Figure 8:
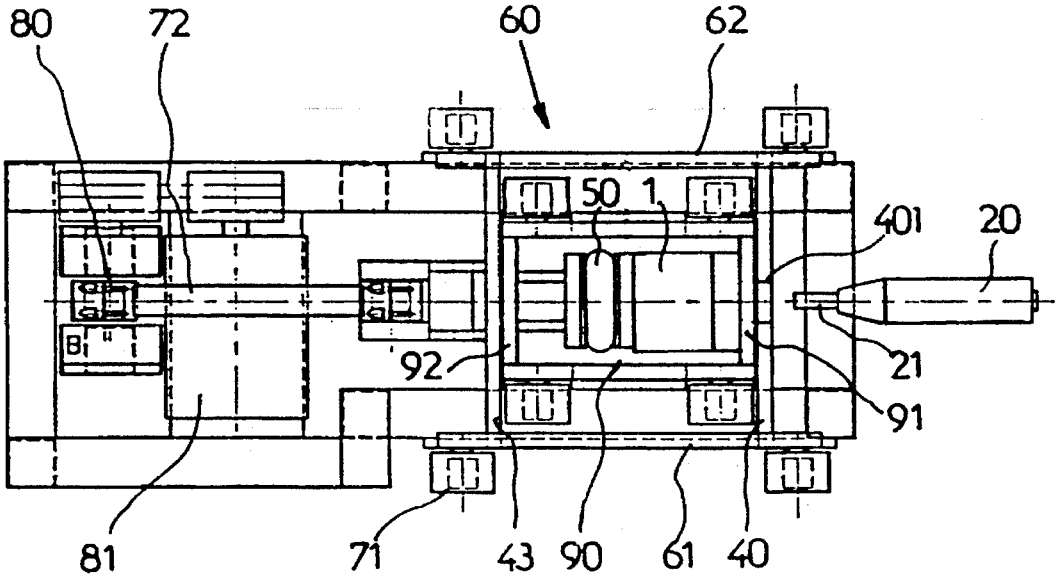
FIG. 8 represents a top view of the device according to FIG. 7, FIGS. 9, 10, and 11 represent respectively a front view, top view and side view of a two-station device.

Under the special embodiment of the invention represented in FIGS. 7 and 8, the piece 1 is secured in receiver 60 through a housing 90 mounted with some play between the connecting plate 43 and the backing plate 40, made integral with the side plates 61 and 62 and the backing plate 40, made integral with side plates 61 and 62 of the receiver or of the frame (as represented in the figures) through four vertical small rods 73 secured through elastic joint 71. The piece is blocked against one of the small sides 91 of the housing located toward the pneumatic hammer 20 through a chamber jack 50 backing against the opposite small side 92 of said housing 90 with or without interposition of a clamping plate 41. It is thus possible to achieve a combined swinging of piece 1 through receiver 60 and housing 90 together with the shocks due to the play provided for between the housing and the connecting plate 43 and the backing plate 40.

Figures 9, 10, 11:
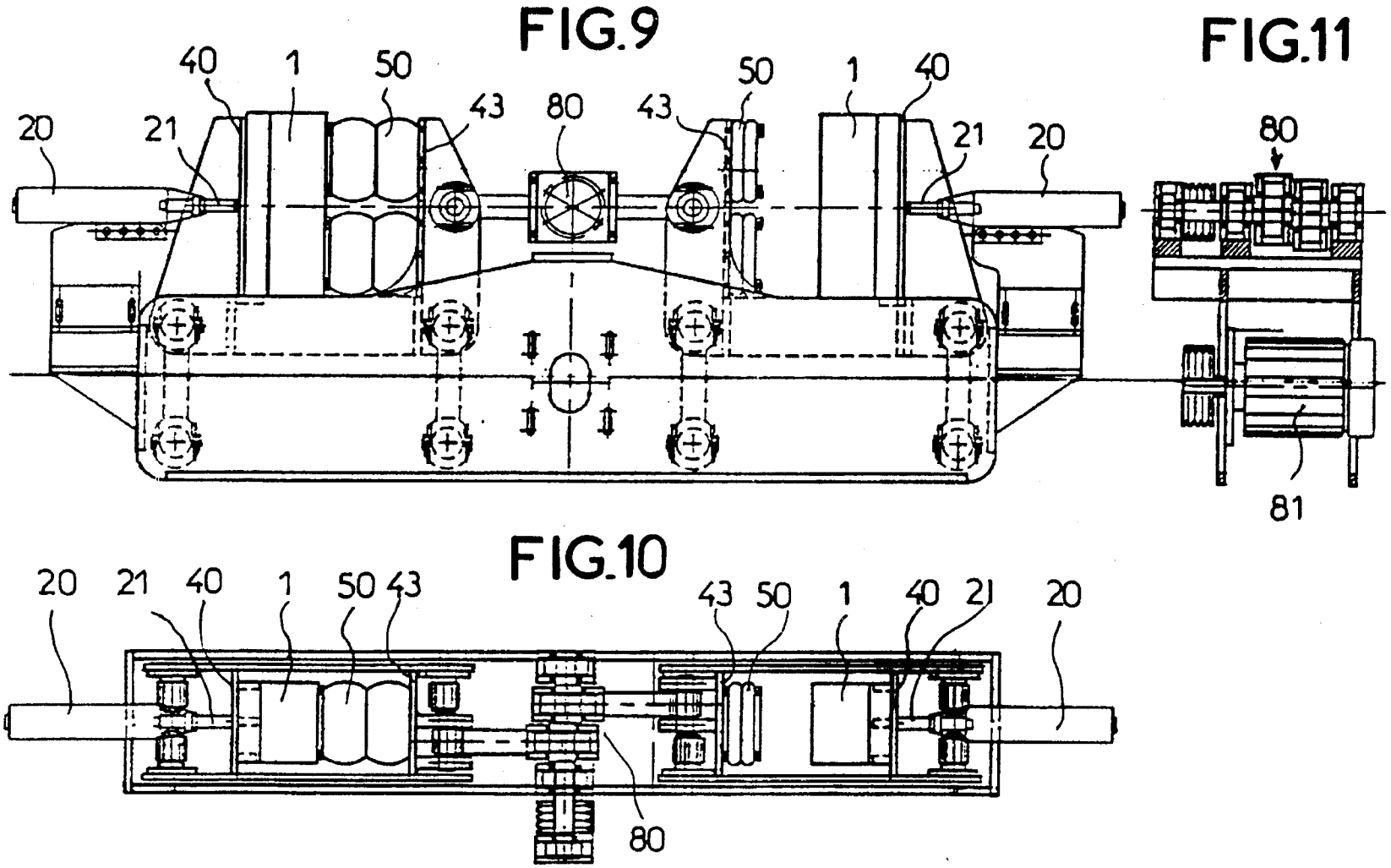

One can see that it is advantageous to combine two devices so as to use them jointly, i.e., the double cam and its drive motor, as represented in FIGS. 9, 10 and 11.

Figure 12:
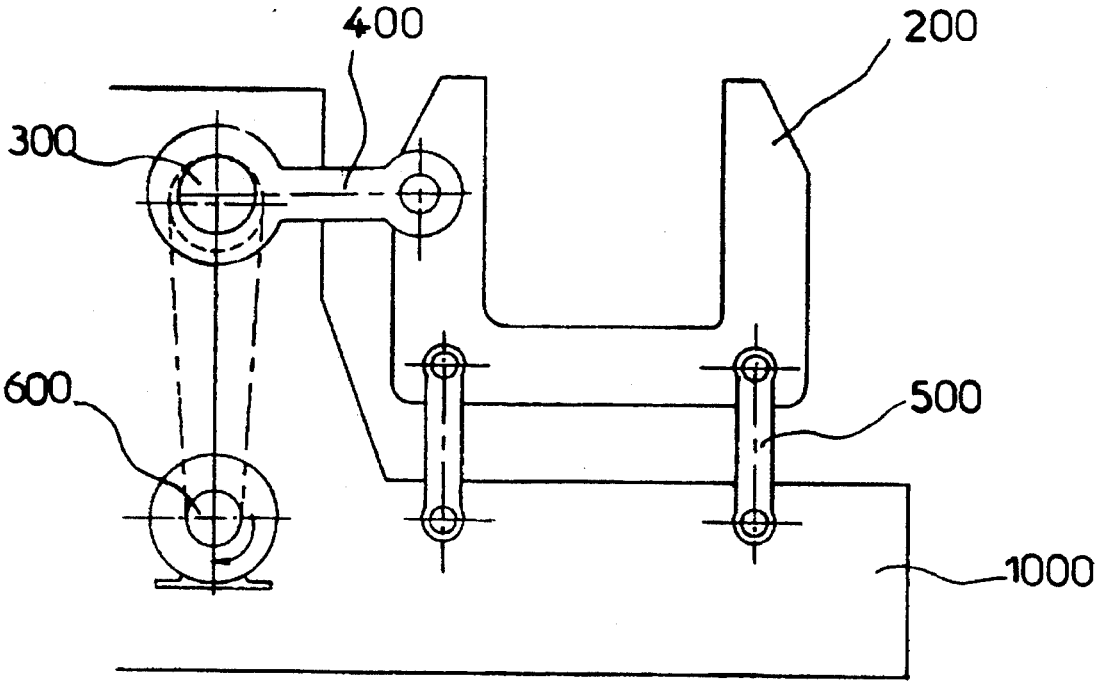
FIG. 12 represents a schematic front view of the decoring device according to an embodiment corresponding to the second process application option.
Figure 13:
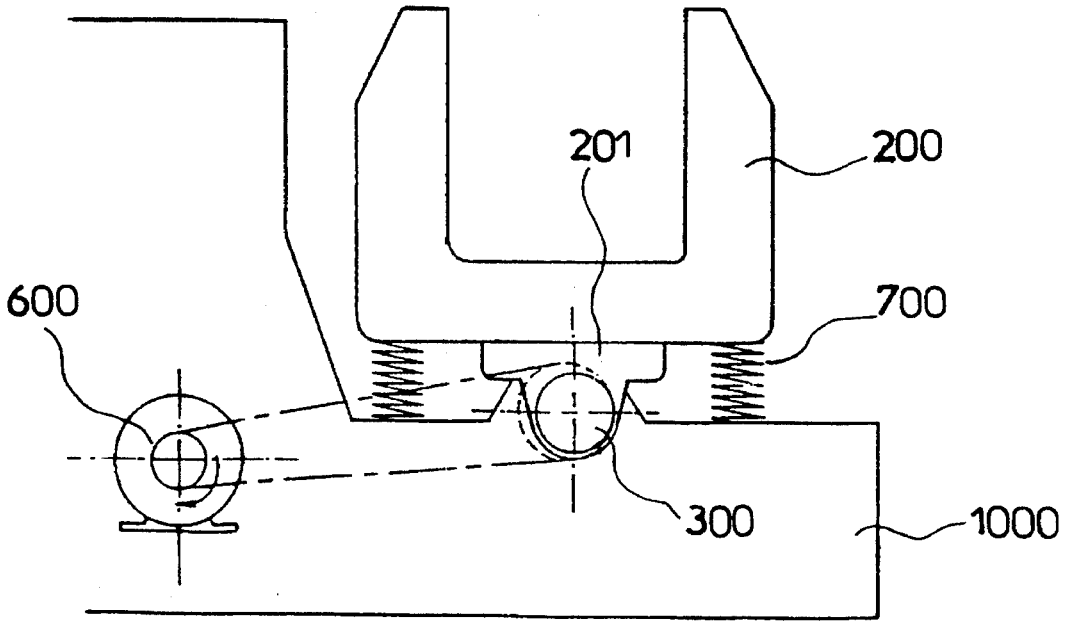
FIG. 13 represents a schematic front view of the decoring device according to an embodiment corresponding to the second process application option.
Figure 14:
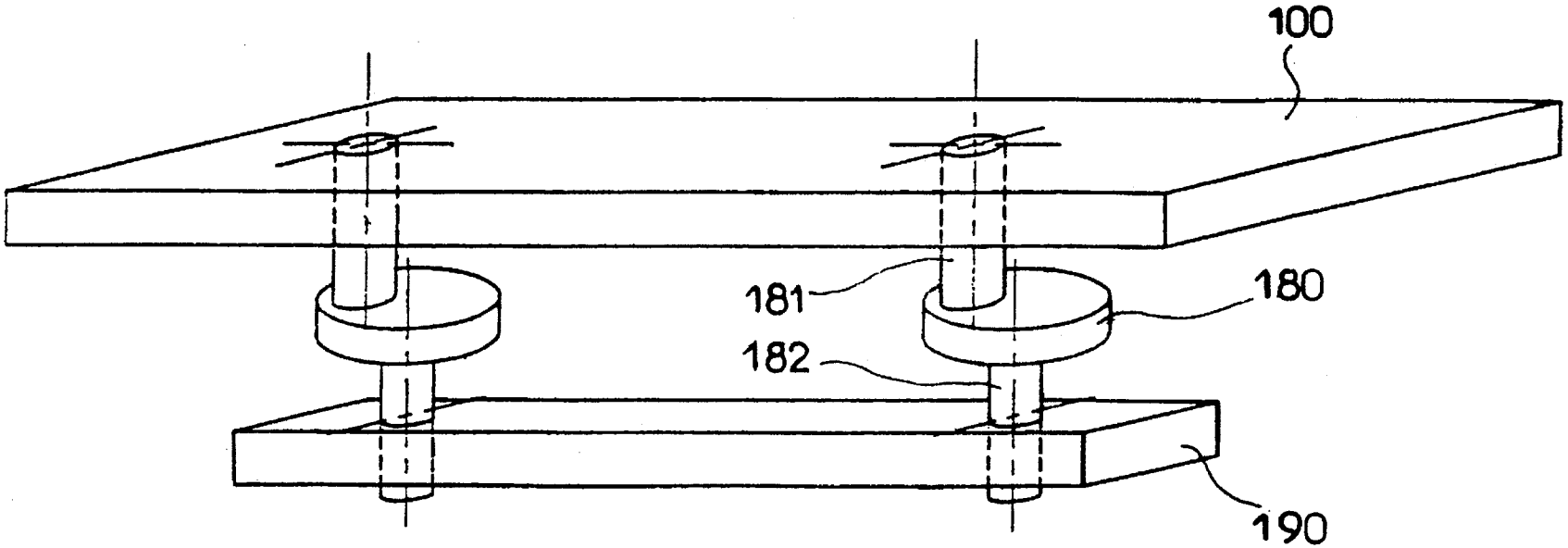
FIG. 14 represents a schematic side view in perspective of the decoring device according to the first process application option under the invention, which corresponds to a special embodiment thereof.

FIGS. 12 through 14 represent a frame 1000,190 supporting a piece-holding capsule 200 or a capsule support 100 through small rods 500, springs 700 or crankshafts 180, respectively actuated by a crankshaft 300, one or more rods 400 and a drive motor 600.

A closer examination of FIG. 12 shows that the piece-holding capsule 200 is connected to frame 1000 through the small rods 500 which may be common to those allowing for the longitudinal swinging provided that their joints are designed accordingly (knuckle socket joints or double pin joints); the lateral swinging is provided by rod 400 imparted with a reciprocating motion through crankshaft 300. It is obvious to the professional that the frequency of the reciprocating motion thus generated and maintained with motor 600 can be made random just by random variation of the rotation speed of said motor 600, which can easily be achieved with an electronic variator controlled accordingly.

When referring to FIG. 13, it should be noted that in this embodiment the piece-holding capsule 200 is directly connected to the frame 1000 through shaft 300 from below said capsule 200 and two rows of springs 700 arranged on both sides of the crankshaft and ensuring the return to the vertical position of capsule 200 while creating with said capsule a vibrating system which, combined to random variation of the rotation speed of the crankshaft achieved as described in the above example, will generate and maintain a random reciprocating motion of said piece-holding capsule 200. In this embodiment, the longitudinal swinging may be achieved through reciprocating sliding of bearing 201 which connects the piece-holding capsule 200 to crankshaft 300 on the crank pin of said crankshaft, provided that the length of the latter has been predetermined to offer adequate free sliding.

A closer examination of FIG. 14 shows that in this embodiment the longitudinal swinging and transverse swinging of support 100 are combined in the circular movement of crank pin 181 of crankshafts 180 in relation to the drive shaft 182 of the latter. The swinging movement thus obtained can be made irregular or random also in this case by varying the rotation speed of the crankshaft drive motor, using the process already described in other examples.

It should be pointed out that in the examples represented in FIGS. 12 and 13 the longitudinal swinging frequency can also be made random through random variation of the rotation speed of the motor assigned to that function.

The process and device under the invention concern mainly the decoring of internal combustion motor cylinder heads; however, there is nothing against their being used to remove the core from other castings with the same internal complexity subject to minor adjustments.

We claim:

1. A splitting and removal process for removing a sand core from a cast piece comprising the steps of:

applying shocks at high frequency directly onto the piece while the piece is held against an air cushion to achieve splitting of the core, subjecting the piece to reciprocating horizontal swinging so as to achieve full disintegration of the core into sand and a sandblasting effect of inside walls of the piece, and gravity-discharging the sand as the core is disintegrated.

2. The process according to claim 1, wherein said horizontal swinging comprises the step of:

applying a reciprocating longitudinal motion and a reciprocating transverse motion to the piece.

3. The process according to claim 2, wherein said reciprocating transverse motion is applied in a plane parallel to a plane of the longitudinal motion.

4. The process according to claim 2, wherein said reciprocating transverse motion is applied in a plane perpendicular to a plane of the longitudinal motion.

5. The process according to claim 1, wherein said reciprocating swinging of the piece further comprises:

providing play so as to produce an additional inertia effect on the sand.

6. The process according to claim 1, wherein the swinging of the piece has an amplitude adjustable from greater than 0 to 10 cm.

7. The process according to claim 1 wherein the amplitude and frequency of the step of swinging vary according to the internal structure of the piece and the size of cavities within the piece.

8. The process according to claim 7, wherein the step of swinging has a frequency ranging from 0 to 85 Hz.

9. The process according to claim 1, wherein the step of swinging has a frequency which is irregular and random.

10. The process according to claim 2, wherein the transverse reciprocating motion is achieved through a crankshaft connected to a piece-holding capsule through at least one rod, said piece-holding capsule is supported by a frame through four rods jointed in planes perpendicular to the crankshaft, the frequency of the reciprocating swinging is irregular and random through a variation of the crankshaft drive motor rotation speed.

11. The process according to claim 2, wherein the longitudinal reciprocating motion and the transverse reciprocating motion are combined in one single motion.

12. A device for applying high frequency shocks directly onto a casting piece having material within the piece, the device comprising:

a pneumatic hammer mounted on a support integral with a frame arranged in such a manner so as to directly hit the piece as the pneumatic hammer moves through a hole in a fixed backing plate, the piece is held against said backing plate through a clamping plate and a low pressure chamber jack forming an air cushion;

a receiver comprising the backing plate, the clamping plate, and the chamber jack for swinging the piece in a reciprocating motion, said receiver connected to the frame vertically with four connecting rods and with a connecting rod actuated by a double cam rotation driven through a drive motor; and a mechanical stop integral with the backing plate for causing gravity discharge of material within the piece by abutting against the piece in a vertical position.

13. The device according to claim 12, wherein the receiver is made of two side plates in a swan neck shape interconnected through the backing plate and through a connecting plate supporting the pneumatic chamber jack.

14. The device according to claim 13, wherein the vertical connecting rods are connected to the side plates through elastic joints.

15. The device according to claim 13, wherein said connecting rod is connected to the connecting plate through a strap.

16. The device according to claim 12, wherein said receiver comprises two receivers mounted on one single frame on both sides of one single double cam, said receivers in alignment with two pneumatic hammers placed at each end of the frame.

17. The device according to claim 12, further comprising:

a sleeve of a length corresponding to a thickness of the piece mounted on slides between the backing plate and the clamping plate.

18. The device according to claim 15, further comprising:

two jacks mounted opposite to each other across the connecting plate with a rod of one attached to the strap and a rod of the other one controlling play between the piece and the clamping plate.

19. The device according to claim 13, wherein said piece being placed in the receiver through a housing mounted with play between the connecting plate and the backing plate, said piece (1) being immobilized against a small side of the housing located toward the pneumatic hammer through the chamber jack abutting against an opposite side of the housing.

20. The device according to claim 12, further comprising: a crankshaft connected to the receiver through at least one bearing installed under the latter and through springs vertically interposed between the receiver and the frame.

21. The device according to claim 20, wherein the crankshaft is installed in the longitudinal median plane of the receiver while the springs are distributed in two rows arranged symmetrically to the crankshaft.

22. The device according to claim 12, wherein a speed variation of the drive motor is achieved through a computer-controlled variator.

* * * * *